US009566591B2

(12) United States Patent
Ballhause

(10) Patent No.: US 9,566,591 B2
(45) Date of Patent: Feb. 14, 2017

(54) CLOSABLE CENTRIFUGE CUP

(71) Applicant: Thermo Electron LED GmbH, Langenselbold (DE)

(72) Inventor: Norman Ballhause, Windhausen (DE)

(73) Assignee: Thermo Electron LED GmbH, Langenselbold (DE)

( * ) Notice: Subject to any disclaimer, the term of this patent is extended or adjusted under 35 U.S.C. 154(b) by 178 days.

(21) Appl. No.: 14/060,843

(22) Filed: Oct. 23, 2013

(65) Prior Publication Data

US 2014/0113796 A1 Apr. 24, 2014

(30) Foreign Application Priority Data

Oct. 23, 2012 (DE) ..... 10 2012 020 783

(51) Int. Cl.
*B04B 7/08* (2006.01)
*B04B 5/04* (2006.01)

(52) U.S. Cl.
CPC ..... *B04B 7/08* (2013.01); *B04B 5/0421* (2013.01)

(58) Field of Classification Search
CPC ..... B04B 7/08; B04B 5/0421; B04B 5/0414; B04B 2005/0435; B04B 7/00; B04B 7/02; B04B 7/04; B04B 7/06; B04B 2007/025
USPC ..... 494/16, 20, 43, 12, 38, 60
See application file for complete search history.

(56) References Cited

U.S. PATENT DOCUMENTS

| | | | | |
|---|---|---|---|---|
| 4,356,957 | A | 11/1982 | Eberle | |
| 6,286,838 | B1 * | 9/2001 | Kruger et al. | 277/549 |
| 2010/0004109 | A1 * | 1/2010 | Ballhause | 494/40 |
| 2012/0306159 | A1 * | 12/2012 | Mittler et al. | 277/469 |

FOREIGN PATENT DOCUMENTS

| | | | |
|---|---|---|---|
| DE | 10128539 | A1 | 1/2003 |
| DE | 102008031502 | A1 | 1/2010 |
| DE | 102009049788 | B3 * | 1/2011 |
| EP | 0025945 | A1 | 4/1981 |

(Continued)

OTHER PUBLICATIONS

Espacenet, English Machine Translation of EP0025945A1, retrieved on Oct. 17, 2013 from http://worldwide.espacent.com, published on Apr. 1, 1981 (11 pages).

(Continued)

*Primary Examiner* — Charles Cooley
*Assistant Examiner* — Shuyi S Liu
(74) *Attorney, Agent, or Firm* — Wood Herron & Evans LLP

(57) ABSTRACT

A closable centrifuge cup comprising a cup and a lid which can be placed on the cup edge to close the cup opening and can be fastened under tension by means of at least one clamping element with its lid edge to the cup edge. The cup edge or a gasket arranged in the region of the cup edge protrudes further in the direction towards the lid edge in a region remote from the at least one clamping element in the circumferential direction of the cup edge than in a region situated closer to the at least one clamping element. Alternatively, the lid edge or a gasket arranged in the region of the lid edge protrudes further in the direction towards the cup edge in a region remote from the at least one clamping element in the circumferential direction of the lid edge than in a region situated closer to the at least one clamping element.

11 Claims, 3 Drawing Sheets

(56) References Cited

FOREIGN PATENT DOCUMENTS

GB 2461377 A 1/2010

OTHER PUBLICATIONS

Espacenet, English Machine Translation of DE102008031502A1, retrieved on Oct. 17, 2013 from http://worldwide.espacent.com, published on Jan. 14, 2010 (10 pages).
Espacenet, English Machine Translation of DE10128539A1, published Jan. 2, 2003, retrieved from http://worldwide.espacenet.com on Feb. 20, 2014 (5 pages).

* cited by examiner

FIG. 3
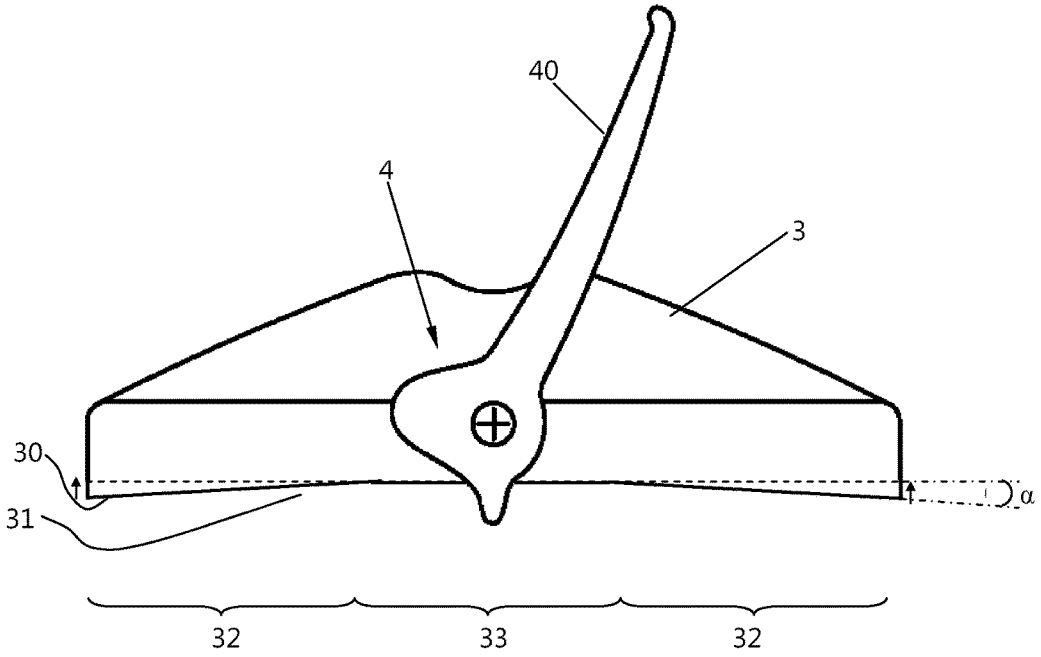
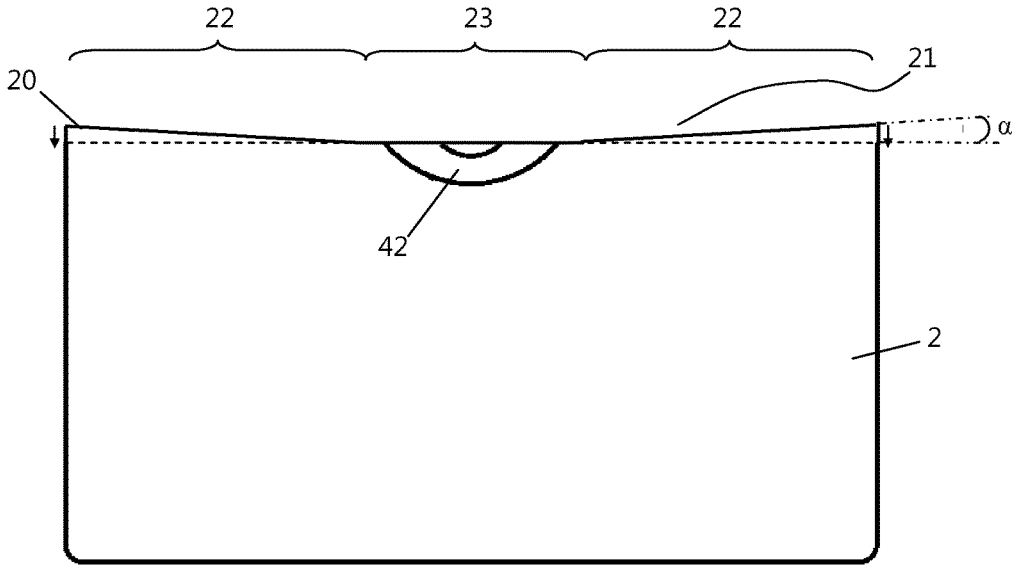
FIG. 4

CLOSABLE CENTRIFUGE CUP

CROSS-REFERENCE TO RELATED APPLICATIONS

The present application claims priority under 35 U.S.C. §119 of German Patent Application No. 10 2012 020 783.2, filed Oct. 23, 2012, the disclosure of which is hereby incorporated herein by reference in its entirety.

FIELD OF THE INVENTION

The present invention relates to a closable centrifuge cup, comprising a cup and a lid which can be placed on the cup edge and closes the cup opening. The lid can be fixed by means of at least one clamping element with its lid edge on the cup edge under tension. Such centrifuge cups are used, for example, for accommodating centrifuge tubes in a centrifuge with a swinging bucket rotor.

BACKGROUND OF THE INVENTION

Such a centrifuge cup has been described, for example, in DE 10 2008 031 502 A1 of the Applicant. The lid of the centrifuge cup comprises two clamping elements in this case which are opposite of one another in the circumferential direction and which can be actuated jointly via a clamping bracket. The clamping elements respectively comprise dovetail-shaped clamping noses for fixing to the cup, which clamping noses can be inserted into associated bow-shaped grooves at the upper end of the cup and press the lid against the cup edge. An annular gasket is arranged between the lid edge and the cup edge, which gasket ensures aerosol-tight locking between the two parts.

The aforementioned construction is easy to operate and offers good aerosol tightness in the case of small to medium-sized centrifuge cups. It may occur in very large centrifuge cups, however, that the lid edge is no longer pressed with sufficient tension against the cup edge in the regions which are remote from the clamping elements, so that the aerosol tightness is no longer satisfactory.

SUMMARY OF THE INVENTION

It is, therefore, an object of the present invention to remedy this disadvantage of the prior art and to ensure sufficient tightness between the centrifuge cup and centrifuge lid even in the case of very large centrifuge cups, without making the construction unnecessarily complex.

In detail, the present invention accordingly relates to a closable centrifuge cup, comprising a cup and a lid which can be placed on the cup edge and closes the cup opening. The lid can be fixed by means of at least one clamping element with its lid edge to the cup edge under tension. The centrifuge cup according to one embodiment of the present invention is arranged in such a way that the clamping pressure between the lid edge and the cup edge is increased in a region remote from the at least one clamping element in relation to the clamping pressure in the region close to the at least one clamping element. This is achieved by the cup edge, or a gasket arranged in the region of the cup edge, protruding further in the direction towards the lid edge in a region which is remote from the at least one clamping element in the circumferential direction of the cup edge than in a region situated closer to the at least one clamping element. As an alternative, or in addition to this measure, the lid edge or a gasket arranged in the region of the lid edge can protrude further in the direction towards the cup edge in a region which is remote from the at least one clamping element in the circumferential direction of the lid edge than in a region closer to the at least one clamping element.

As a result of this protrusion, which is provided remote from the clamping element and which will also be referred to below as "superelevation", and the resulting approach of the peripheral regions of the cup and the lid of the centrifuge cup resting on each other, an increase in the clamping pressure is achieved in a very simple way in a region which is remote from the at least one clamping element, and leakage at this point is thus prevented without requiring further clamping elements or additional parts in the production of the centrifuge cup. The desired clamping pressure can be established by corresponding adjustment of the superelevation to the suitable size. It is possible to provide the superelevation either exclusively at the cup edge or exclusively at the lid edge or also simultaneously at both edges. As an alternative, or in addition, the superelevation can also be produced by variation of the gasket itself, e.g., in that the thickness of the gasket changes in the circumferential direction. It should, however, be ensured in this case that the gasket is unable to inadvertently displace in the circumferential direction in the cup edge or lid edge. It is possible in this case too to arrange a gasket either at the cup edge or at the lid edge or at both edges simultaneously.

In a preferred embodiment of the present invention, the gasket rests in a groove whose depth changes in the circumferential direction and is lower in a region which is remote from the at least one clamping element than a region which is closer to the at least one clamping element. In this case, a gasket is preferably used whose thickness does not change in the circumferential direction, but which protrudes more or less far in the direction towards the counterpart to be sealed (i.e., the cup or the lid) only as a result of the changing depth of the groove.

The ascent in the region remote from the clamping element can occur in one or several stages or preferably continuously and especially preferably in a continuous manner up to the point which is farthest from the at least one clamping element. If the centrifuge cup comprises more than only one clamping element, a superelevated section is preferably present between two respective clamping elements which are adjacent in the circumferential direction. In a preferred embodiment of the present invention, the centrifuge cup according to one embodiment of the present invention comprises two clamping elements which are opposite one another in the circumferential direction, as has already been described in DE 10 2008 031 502 A1.

The present invention can principally be applied to all types of centrifuge cups, whether they are of round, oval, rectangular or any other shape in cross-section. The at least one clamping element can principally also be arranged in any desired fashion. It can be fixed to the lid, the cup or both parts. Possible alternatives to the clamping mechanism described in DE 10 2008 031 502 A1 are the use of tension clamps, clamping brackets spanning the lid or other clamping devices. The present invention, however, allows reducing their number to a minimum, because the superelevated sections will ensure sufficient tightness between the lid and the cup even in regions which are remote from the clamping devices. As a result, the costs of the centrifuge cup and the effort in opening and closing can be minimized. Even one single clamping element can principally be sufficient, for example, in cooperation with a holding element which can be a hinge, for example, for the tight fixing of lid and cup to each other.

There are also no special limitations concerning the materials from which the centrifuge cup according to the present invention is made. Materials which are conventionally used in the prior art can also be used in this case. It is preferable, however, to make the lid of plastic in such a manner that it is elastically deformable at least in the region of the lid edge. As a result, the lid edge will be able to bend back during the clamping of lid and cup in the superelevated sections, i.e., in the regions remote from the clamping elements. It is especially preferred to adjust the ascent of the superelevated region to the elasticity of the lid, which preferably occurs in such a way that the lid edge will bend back to such an extent that in the state in which the lid and the cup are fixed to each other two substantially flat sealing surfaces come to rest on top of one another and the clamping pressure achieved is as constant as possible in all regions of the circumference. In the case of a continuous ascent, angles of inclination of 0.03 to 1°, especially 0.08 to 0.8° and, more preferably, 0.2 to 0.5°, have proven to be suitable. The plane of reference is a plane which is perpendicular to the longitudinal center axis of the cup, which leads through the center point of the cup opening.

In order to ensure even tightening of the at least one clamping element, it can be preferred to not yet provide any ascending region protruding in the direction of the counterpart in the area of the cup edge and/or lid edge directly adjacent to the clamping element, but rather to allow this peripheral region to extend in a plane which is a horizontal plane intersecting the vertical longitudinal center axis of the centrifuge cup at a right angle. The same can also apply when the superelevation is caused by the height of the protrusion of the gasket varying in the circumferential direction. In this case, the protrusion of the gasket in the region adjacent to the at least one clamping element extends at constant height and the protruding edge of the gasket lies in a plane in this circumferential section.

BRIEF DESCRIPTION OF THE DRAWINGS

The present invention will be explained below in closer detail by reference to the drawings. The drawings are purely schematic, wherein identical reference numerals refer to identical parts.

FIG. 3 shows the side view of a lid of a centrifuge cup according to one embodiment of the present invention;

FIG. 4 shows the side view of a centrifuge cup according to one embodiment of the present invention.

DETAILED DESCRIPTION OF THE INVENTION

Figure 1:
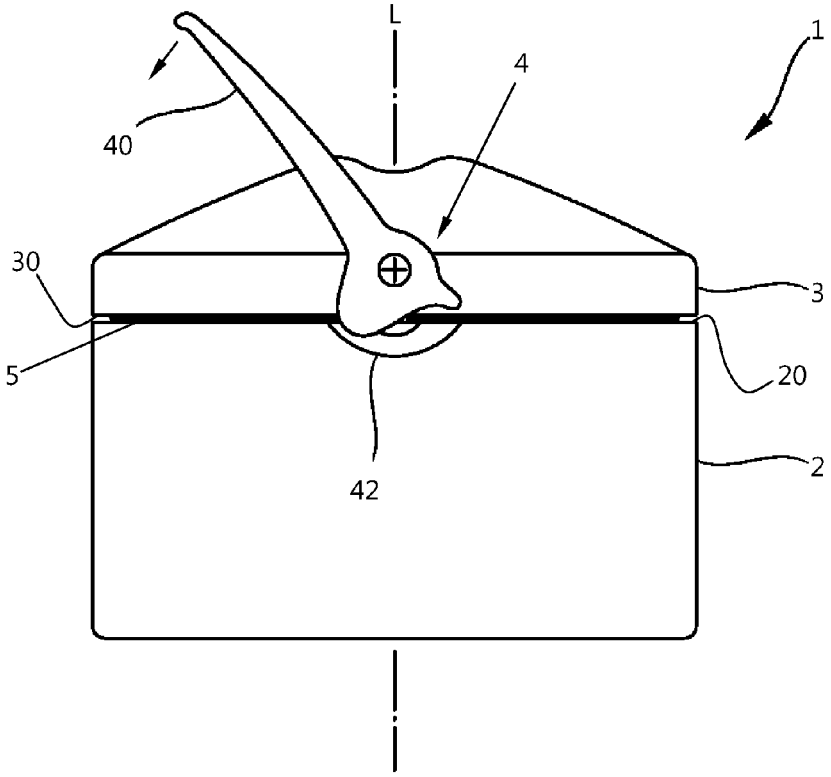
FIG. 1 shows a side view of an exemplary embodiment of a centrifuge cup according to the present invention.

FIG. 1 shows an exemplary embodiment of a centrifuge cup 1 according to the present invention, comprising a cup 2 and a lid 3 which closes said cup. The principal configuration of the illustrated centrifuge cup 1 corresponds to the centrifuge cups described in DE 10 2008 031 502 A1. For example, the cup 2 can have a round or polygonal cross-section in a cross-sectional view perpendicular to the longitudinal center axis L of the cup 2. Any other cross-sections are principally also possible. The progression of the lid edge 30 follows the progression of the cup edge 20 which encloses the cup opening, which is covered in the present case by the lid 3. The lid 3 and the cup 2 can, therefore, be placed in a custom-fit manner onto each other with their edges 20 and 30. A gasket 5 is arranged between the two parts, for example, in form of an O ring made of an elastomeric plastic material, which seals the lid and the cup in the mutually fastened state in an air-tight and aerosol-tight manner against one another.

For the purpose of tightly clamping the lid 3 on the cup 2, two clamping elements 4 are used in the present case, whereof the one on the side of the centrifuge cup 1 facing away from the spectator is not visible. The two clamping elements 4 are connected by a clamping bracket 40, with which both clamping elements can be actuated simultaneously. In order to fasten the lid 3 on the cup 2 under tension, the clamping bracket 40 is pressed down in the direction of the arrow. FIG. 1, therefore, shows a state in which the lid 3 has not yet been pressed completely onto the cup 2.

Figure 2:
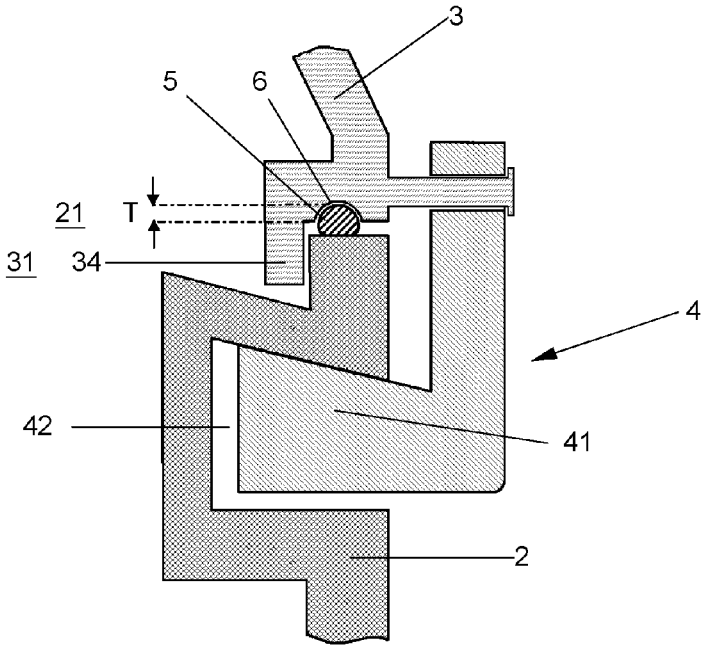
FIG. 2 shows a partial cross-sectional view of the centrifuge cup of FIG. 1 in the region of a clamping element.

FIG. 2 illustrates the functionality of the clamping elements and shows the centrifuge cup of FIG. 1 according to one embodiment of the present invention in a partial cross-sectional view in the region of a clamping element 4 in a plane of intersection which extends perpendicularly to the paper plane and includes the longitudinal center axis L. A state is now illustrated in which the lid 3 is pressed completely onto the cup 2, and the clamping bracket 40 has, therefore, been moved to its horizontal end position. During the movement of the clamping clip 40, the clamping element 4, which comprises a wedge-shaped clamping nose 41 protruding in the direction towards the outside wall of the cup 2, is guided into a matching arc-shaped groove 42 and draws the lid edge 30 onto the cup edge 20, whereupon the gasket 5 resting in a groove 6 of the lid edge 30 is compressed and is pressed against the cup edge 20. As a result, the lid 3 and the cup 2 are sealed in an air-tight manner with respect to each other.

The centrifuge cup 1 according to one embodiment of the present invention differs from the centrifuge cup described in DE 10 2008 031 502 A1 in such a way that the depth T of the groove 6 changes in the circumferential direction of the lid edge 30. Specifically, the depth of the groove in the circumferential sections which lie adjacent to one of the clamping elements 4 is larger than in circumferential sections which are further away from the clamping elements 4. As a result, the gasket 5 whose diameter is constant in the circumferential direction protrudes with larger height beyond the lid edge 30 in the circumferential regions farther away from the clamping elements 4 than in the regions which are situated close to the clamping elements 4. As a result, the loss in the clamping force which decreases with increasing distance from the clamping elements 4 can be compensated, so that even in the case of very large diameters of the cup 2 and the lid 3 it is possible to achieve good tightness between these two parts.

FIGS. 3 and 4 illustrate alternative embodiments of the lid 3 and the cup 2 of a centrifuge cup 1 according to the present invention. FIG. 3 shows a lid 3 whose peripheral shape changes in the circumferential direction around the lid opening 31 in such a way that the lid edge 30, with increasing distance from the clamping elements 4 which are again opposite each other on the circumference of the lid, protrudes further in the direction towards the cup 2 on which the lid 3 is to be fastened. The lid edge 30 itself comprises a flat contact surface as shown in FIG. 2 in which a groove 6 can also be disposed into which a gasket 5 is inserted, as is shown in FIG. 2, but which was omitted in this case for improved recognizability of the other parts. Alternatively, the gasket 5 could also be arranged on the cup edge 20 of the cup 2. The arrangement of a gasket on both the lid and also the cup is also possible.

Figure 5:
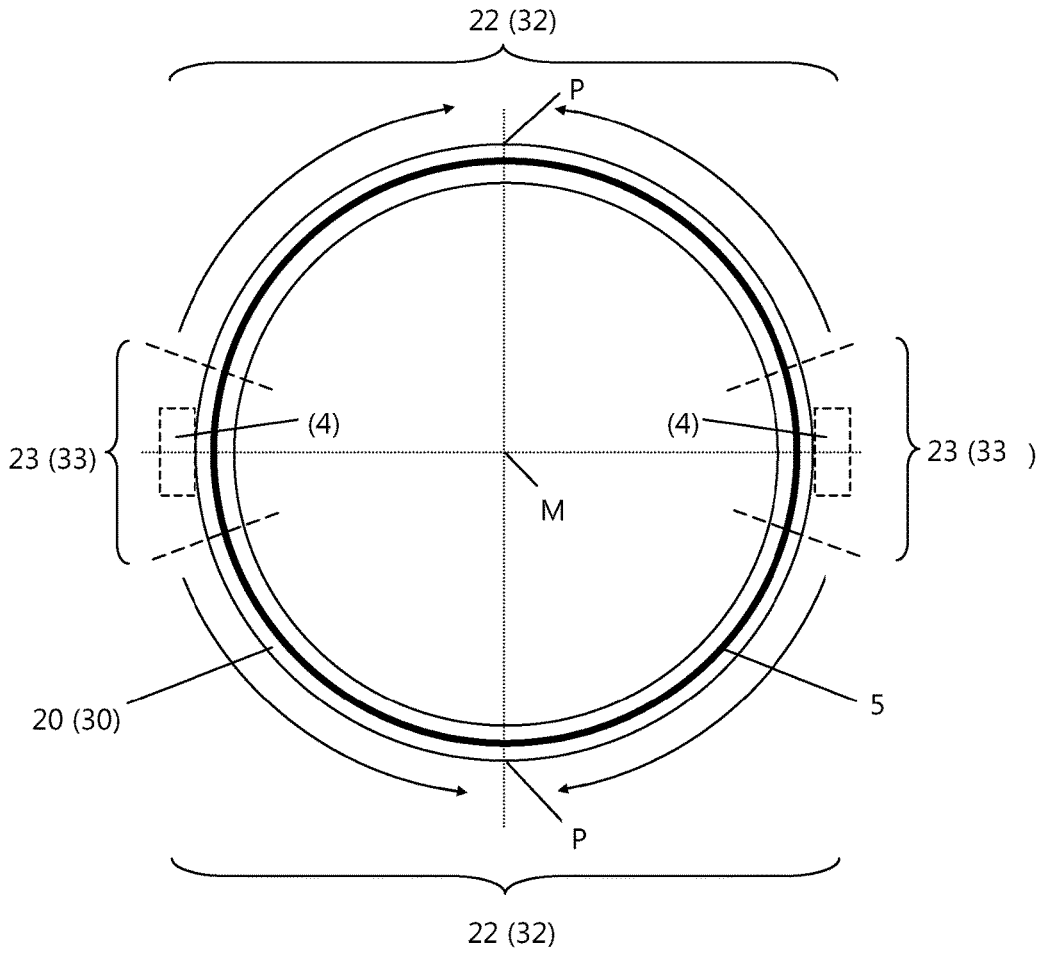
FIG. 5 shows a top view of the opening area of a cup or a lid of a centrifuge cup according to one embodiment of the present invention.

The height progression of the lid edge 30 is additionally shown in FIG. 5. FIG. 5 shows a top view of the lid edge 30 and the lid opening 31 which is enclosed by said edge. A lid with a circular cross-section has been chosen as an example in this case, but this also applies in an analogous manner to other cross-sections of the lid. The illustration shows that the circumference of the lid edge is subdivided into four different sections, i.e., two sections 33 which are situated between the dashed lines adjacent to the clamping elements 4 and two sections 32 which are situated further away from the clamping elements 4. In the regions 33 which are adjacent to the clamping elements 4, the cup edge 30 extends without any ascent in the direction towards the cup edge 20 to be sealed. This means that the lid edge 30 extends in the sections 33 in a plane which perpendicularly intersects the longitudinal center axis of the lid extending through the center point M perpendicularly to the paper plane. Adjacent to the regions 33 bounded by the dashed lines, the lid edge 30 rises continuously in its height in the direction towards the spectator up to the points P which are farthest away from the clamping elements 4, as is indicated by the arrows. The lid edge 30, therefore, has the largest projecting height beyond the plane at the points P, which plane includes the lid edge in the regions 33.

If a lid shown in FIG. 3 is placed on a cup 2 whose cup edge 20 extends horizontally in a plane, this will lead to the consequence that the clamping pressure during tightening of the clamping elements 4 is larger in the regions 33 which are far away therefrom (therefore especially in the region of the points P) than in the case in which the lid edge 30 would extend in a plane. As a result, good tightness between the cup 2 and the lid 3 is even achieved in the regions which are far away from the clamping elements 4. It is especially preferred if the lid 3 is made of a material which allows that the lid edge 30 deforms elastically. This allows the lid edge 30 to be upwardly resilient in the direction indicated by the arrows in FIG. 3 at the edge of the lid, so that in a state in which the lid 3 is fastened to the cup 2 a flat sealing surface is formed between the two edges 20, 30. The angle $\alpha$, with which the lid edge 30 protrudes in the direction towards the cup 2 beyond the horizontal plane through the straight peripheral sections 33, is preferably chosen by adjustment to the elasticity of the lid edge, which occurs in such a way that in the fastened state the clamping pressure achieved is as constant as possible in all regions of the circumference. Suitable angular ranges for the angle $\alpha$ lie between 0.03 and 1°, preferably 0.08 to 0.8°, and especially preferably 0.2 to 0.5°.

FIG. 4 illustrates the progression of the protrusion in the circumferential direction on the basis of an example of the cup edge 20 of a cup 2. The change in the protrusion of the cup edge 20 in the circumferential direction around the cup opening 21 can be applied alternatively or in addition to the change in the peripheral height of the lid 3. The change in height of the cup edge 20 in the circumferential direction principally corresponds to the descriptions made with respect to the lid edge in FIGS. 3 and 5. The reference numerals for the cup are provided alternatively to the reference numerals for the lid FIG. 5. The clamping elements 4 entered in the drawing with the dashed lines are obviously not present on the cup 2. Instead, the cup 2 is provided with grooves 42. In the event that the changes in height are provided both in the cup and also in the lid, it applies to the angle $\alpha$ that the partial angles $\alpha$ for the cup and the lid supplement each other to the total angle $\alpha$ and the values provided for said angle in the descriptions made above.

The descriptions made in connection with FIGS. 3 to 5 can further also be applied in the event that the protrusion height of the gasket 5 changes in the circumferential direction, for example, due to a change in the depth T of the groove 6, as described above with respect to FIG. 2. The depth of the groove 6 changes in this case according to the progression of the height shown in FIG. 5. This means specifically that the depth of the groove remains constant in the regions 23 and 33 but decreases continuously in the regions 22 and 32 in the direction towards the points P, so that at the points P the gasket 5 protrudes farthest in the direction towards the counterpart to be sealed.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A closable centrifuge cup, comprising:

a cup having a cup edge enclosing a cup opening;

a lid positioned on the cup edge to close the cup opening; and at least one clamping element configured to fasten the lid to the cup under tension so as to draw a lid edge of the lid onto the cup edge, wherein the cup edge or a gasket arranged in a region of the cup edge protrudes further in a direction towards the lid edge in a circumferential region of the cup edge remote from the at least one clamping element than in a circumferential region of the cup edge situated closer to the at least one clamping element; and/or wherein the lid edge or the gasket arranged in the region of the lid edge protrudes further in a direction towards the cup edge in a circumferential region of the lid edge remote from the at least one clamping element than in a circumferential region of the lid edge situated closer to the at least one clamping element.

2. The centrifuge cup according to claim 1, wherein an ascent occurs continuously in the circumferential region of the cup edge and/or the lid edge remote from the at least one clamping element and up to the point farthest away from the at least one clamping element.

3. The centrifuge cup according to claim 2, wherein the ascent occurs at an angle ($\alpha$) of 0.03° to 1°.

4. A centrifuge cup according to claim 1, wherein the cup edge and/or the lid edge and/or an edge of the gasket respectively extend in one plane in the circumferential region closer to the at least one clamping element.

5. A centrifuge cup according to claim 1, wherein the cup edge extends in a plane and the lid edge and/or the gasket arranged in the region of the lid edge protrudes further in the direction towards the cup edge in a circumferential region remote from the at least one clamping element than in a circumferential region closer to the at least one clamping element.

6. A centrifuge cup according to claim 1, wherein the gasket rests in a groove whose depth changes in a circumferential direction and is lower in a circumferential region remote from the at least one clamping element than in a circumferential region closer to the at least one clamping element.

7. A centrifuge cup according to claim 1, wherein the lid is made of plastic and is elastically deformable at least in the region of the lid edge.

8. A centrifuge cup according to claim 1, wherein two clamping elements are located opposite each other in a circumferential direction.

9. A centrifuge cup according to claim 8, wherein the clamping elements can be actuated jointly by a clamping bracket.

10. The centrifuge cup according to claim 2, wherein the ascent occurs at an angle (a) of 0.08° to 0.8°.

11. The centrifuge cup according to claim 2, wherein the ascent occurs at an angle (a) of 0.2° to 0.5°.

* * * * *